US006298529B1

(12) United States Patent
Aube et al.

(10) Patent No.: US 6,298,529 B1
(45) Date of Patent: Oct. 9, 2001

(54) METHOD FOR THE FORMATION AND CONDITIONING OF INSULATING FELTS AND A DEVICE TO IMPLEMENT THE FORMATION AND CONDITIONING

(75) Inventors: Jean-Yves Aube, Clermont; Bernard Bichot, Ronquerolles; Bernard Louis, Louveaucourt, all of (FR)

(73) Assignee: Saint-Gobain Isover, Courbevoie (FR)

( * ) Notice: Subject to any disclaimer, the term of this patent is extended or adjusted under 35 U.S.C. 154(b) by 0 days.

(21) Appl. No.: 09/686,899

(22) Filed: Oct. 12, 2000

(30) Foreign Application Priority Data

May 17, 2000 (FR) ..... 00 06265

(51) Int. Cl.[7] ..... D04H 1/16
(52) U.S. Cl. ..... 28/117; 28/121; 28/122
(58) Field of Search ..... 28/116, 117, 121, 28/122, 123, 124, 130, 134, 135, 136, 100, 101, 102; 26/18.6, 7; 53/435, 436, 438, 439, 450, 553, 513, 523, 526, 528, 529; 271/3.18, 3.19, 4.01, 6, 4.05

(56) References Cited

U.S. PATENT DOCUMENTS 480,582 * 8/1892 Kittel ..... 28/117
2,543,101 * 2/1951 Francis, Jr. ..... 28/117
2,986,798 * 6/1961 Koenig et al. ..... 28/116
4,992,227 * 2/1991 Brossy ..... 264/112
5,305,963 * 4/1994 Harey, III et al. ..... 242/55.1
5,425,512 * 6/1995 Bichot et al. ..... 242/541.3
5,671,518 * 9/1997 Kummermehr et al. ..... 28/112
5,832,696 * 11/1998 Nagy et al. ..... 53/430
5,979,145 * 11/1999 Louis et al. ..... 53/439

* cited by examiner

*Primary Examiner*—Amy B. Vanatta
(74) *Attorney, Agent, or Firm*—Oblon, Spivak, McClelland, Maier & Neustadt, P.C.

(57) ABSTRACT

A method for forming and conditioning insulating felts of fibrous products whereby an insulating blanket is transported continuously on a transporting device, the insulating blanket is cut into a plurality of fiber strips, the fiber strips are driven by at least one branching-off and convergence device towards at least one reception conveyor, the fiber strips are superposed one on top of another so as to form at least one longitudinal stack, the at least one longitudinal stack is compressed by a compression device, and the compressed stack is cross cut to form the insulating felts. Such a method is implemented on a device including a transporting device, a longitudinal cutting device, at least one branching-off and convergence device, at least one reception conveyor, a compression device, and a cross-cutting device. The at least one branching-off and convergence device includes individual conveyor belts with each individual conveyor belt having a departure point at a junction of the transporting device and an arrival point aligned along a vertical axis and above the at least one reception conveyor. The fiber strips are superposed one above another on the at least one reception conveyor prior to being packaged and compressed by the compression device and cross-cut by the cross-cutting device.

14 Claims, 5 Drawing Sheets

METHOD FOR THE FORMATION AND CONDITIONING OF INSULATING FELTS AND A DEVICE TO IMPLEMENT THE FORMATION AND CONDITIONING

CROSS-REFERENCE TO RELATED APPLICATIONS

This application claims priority under 35 U.S.C. §119 to French patent application FR 00 06 265 filed on May 17, 2000, the entire contents of which is incorporated herein by reference.

BACKGROUND OF THE INVENTION

1. Field of the Invention

The present invention relates to the formation and conditioning of felts of fibrous insulating products, in particular those products based on mineral fibers.

2. Discussion of the Background

Conventionally, a blanket of fibrous products based on mineral fibers is produced, after various steps, at the outlet of a forming device in which the blanket has been compressed and heated in order to cause the curing of a binder encasing the fibers. The blanket obtained continuously in this way is conveyed on a transporting device and usually has a considerable width which may amount to several meters, for example 3.6 m. In order to use the blanket, it is necessary to cut defined lengths and widths smaller than the manufacturing width in order to obtain felts, the dimensions of which are, for example, 31 cm in width and 1.2 m in length.

Consequently, in a known way, the blanket at the outlet of the forming device is cut longitudinally and along its center line in order to produce two blankets of equal width which are driven, so as to branch off, by means of two separate conveyor belts. These blankets will be referred to hereinafter as half-width blankets.

A half-width fiber blanket, in turn, is sawn longitudinally into a plurality of strips, for example four, of equal width corresponding to the desired width of the felt to be provided. These four strips remain driven parallel to one another and undergo a crosscutting operation, to produce felts of a desired length, by means of guillotines located vertically in line with each traveling strip.

For the purpose of conditioning the felts, each of the four strips which consists of the formed felts is deflected and conveyed by a conveyor towards a compression and packaging machine. This machine comprises a reception device placed directly below the end of the conveyor so as to receive the insulating felts. After a predetermined number of felts have been stacked, the stack is transferred into a conditioning chamber in order to undergo compression in the direction of the stack. A film surrounds the stack. The film is subsequently glued or welded on itself, so as to encircle the stack, and compression can then be released.

Four conveying lines and four compression and packaging machines of the type described above are therefore necessary for the four conveyors conveying the four felt strips of the first half-width blanket, and as many machines are therefore used for the second half-width blanket.

The formation and conditioning of insulating felts consequently requires the use of a large number of transporting and conveying devices and of cutting, compression and packaging machines. In some manufacturing works, however, it is difficult to provide sufficient space to accommodate these conveying lines and these machines.

Moreover, the labor remains high since two persons are usually employed in supervising and maintaining the cutting and conditioning machines. Finally, these machines which are expensive to purchase, increase the cost price of an installation as a whole.

SUMMARY OF THE INVENTION

Accordingly, one object of the invention is to manufacture and condition insulating felts, without requiring considerable conveying, cutting, compression and packaging means, consequently reducing labor demand.

According to the invention, a method for the formation and conditioning of insulating felts of fibrous products includes transporting an insulating blanket continuously on a transporting device, longitudinally sawing of the insulating blanket into a plurality of parallel fiber strips, driving the fiber strips via at least one branching-off and convergence device towards at least one reception conveyor, superposing the fibers one on top of another so as to form at least one longitudinal stack of mineral strips, compressing the at least one longitudinal stack by a compression device, and cross-cutting in the compressed state the at least one longitudinal stack to form the insulating felts.

According to one characteristic, the parallel fiber strips on the transporting device are deflected from a traveling plane in rising and/or falling angular directions which converge towards an axis which is perpendicular to the traveling plane and level, such that the vertically spaced strips arrive in coplanar form.

According to another characteristic, the coplanar fiber strips are deposited by gravity onto the reception conveyor, so as to be superposed in alignment in order to form the longitudinal stack.

Before the step of cross-cutting the compressed stack (i.e. to obtain the felts), the stack is packaged around its longitudinal and lateral faces.

Preferably, during the compression of the stack, the compression device drives onto the stack at least one packaging film intended for covering the said longitudinal and lateral faces of the stack.

Advantageously, two packaging films are used in order to be applied against the longitudinal faces, then turned down against the lateral faces after the compression of the stack and connected to one another by a mutual fastening mechanism.

When the fiber blanket at the outlet of the forming device is cut into two blankets of identical width, there is a provision for the fiber strips obtained from the two blankets to be branched off according to two branching-off and convergence devices, in order to deliver two respective stacks onto two respective reception conveyors. The two reception conveyors are positioned so as to converge at a downstream end towards a third reception conveyor, in order to ensure that the two strip stacks are superposed in a third final stack intended to be processed by the compression device.

It is sometimes expedient, before the step of longitudinally sawing the blanket into a plurality of strips, to cover upper and lower faces of the blanket with a functional covering and, simultaneously with or just downstream of this covering step to split the blanket in into according to its thickness.

According to one embodiment of the present invention, the device configured to implement the method is characterized in that the branching-off and convergence device includes individual conveyor belts for each of the fiber strips, the conveyor belts having a departure point at the junction of the transporting device and in alignment with the fiber strips and an arrival point aligned along a vertical axis and above the reception conveyor.

Preferably, guide flanges are provided on each side of and at the upstream end of the reception conveyor, in order to ensure the alignment of the stack.

According to one characteristic, the compression device includes two converging tracks, the pressing surfaces of which are provided with packaging films deposited on the longitudinal faces of the stack simultaneously during stack compression.

According to another characteristic, a cutting device is arranged downstream of the compression device and cross-cuts the compressed, packaged stack.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 1A:
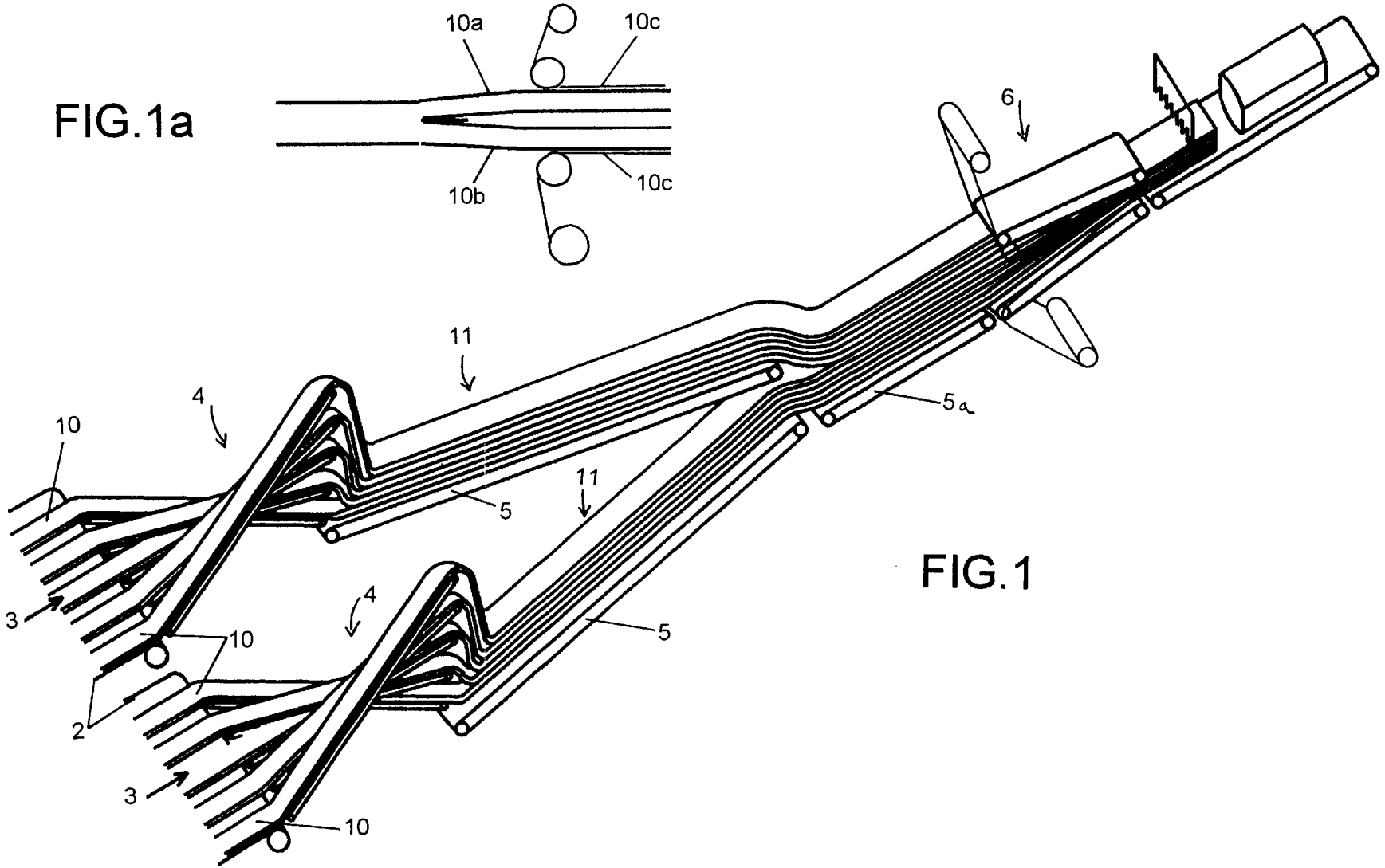
FIG. 1 illustrates a partial view of an installation for the formation and conditioning of felts according to the invention.
FIG. 1*a* is an elevation view of a step in the manufacture of the felts of the invention.

Referring now to drawings, wherein like reference numerals designate identical or corresponding parts throughout the second views, and more particular to FIG. 1 thereof, FIG. 1 shows strips 10 of mineral wool, which are obtained in a well known way, by circular saws not illustrated, from longitudinal cuts of two half-width blankets of mineral wool. The half-width blankets are obtained from a blanket split into longitudinally when the final dimensions of the desired felts make this necessary; this is true, in fact, of a blanket having a width of 3.6 m at the outlet of its forming device, the final felts having to be of a width of 0.31 m.

Each half-width blanket is cut into four mineral strips 10 which are supported and driven in parallel by a transporting device 2 moving horizontally in the direction of the arrow 3.

Depending on the desired thickness of the final felt, a horizontal cut is sometimes made in a known way, at the output of the forming device and downstream of the cut of the half-width blanket, in order to split the thickness of the blanket in two. There may be a provision, furthermore, simultaneously with or just upstream of the horizontal cut, to cover the upper 10*a* and lower 10*b* faces of the blanket with a functional covering 10*c*, as illustrated in FIG 1*a*.

A branching-off and convergence device 4, which can be seen in FIGS. 1 to 4, is provided, as an interruption of the transporting device 2, in order to convey the four mineral strips 10 separately in rising and falling angular directions in relation to the horizontal direction 3 and converging towards an axis A perpendicular to the horizontal plane of the transporting device 2.

The purpose of the branching-off and convergence device 4 is to convey the mineral strips 10, originally parallel to one another, so as to position them one above another in a vertical plane.

The branching-off device 4 consists of four conveyor belts 40 which commence at the junction of the transporting device 2 along the axis of each traveling mineral strip 10 and which terminate at ends 41 vertically in line with a reception conveyor 5.

Figure 2:
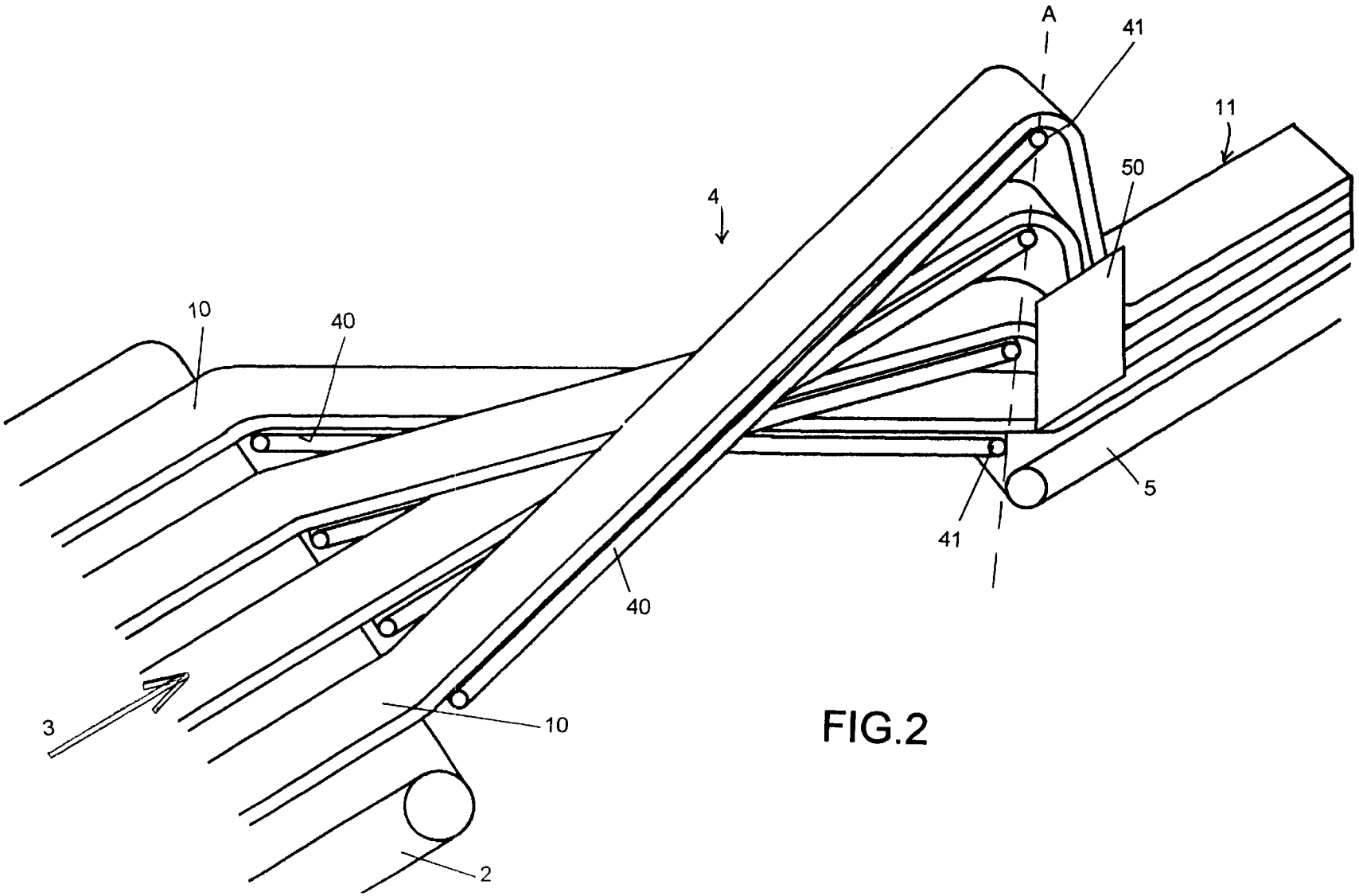
FIG. 2 shows a profile view of the upstream part of the device according to the invention.

The conveyor belts 40, as shown in FIG. 2, are capable of being inclined angularly in a vertical plane perpendicular to the horizontal direction 3, and a separating height between each conveyor belt is set in order to provide a sufficient space corresponding at least to a thickness of one mineral strip. The thickness of the mineral strip is a function of the thickness of the blanket at the outlet of the forming device.

The conveyor belts 40, as shown in FIG. 2, are likewise capable of being inclined angularly in a horizontal plane parallel to the horizontal direction 3, in order to set the position of the ends 41 along the same vertical axis A level with the reception conveyor 5.

Finally, the length of the conveyor belts 40 is adjusted as a function of the traveling speed of the mineral strips 10, in such a way that the four mineral strips 10 arrive level with the ends 41 in perfectly coplanar form.

The reception conveyor 5 receives the four mineral strips 10 which are superposed one above the other to form a longitudinal and aligned stack 11 of mineral strips.

The mineral strips 10 are superposed by sliding as a result of gravity from the ends 41 onto the reception conveyor. Consequently, the reception conveyor 5 is always located below the conveyor belt 40 which falls at the sharpest angle.

Figure 3:
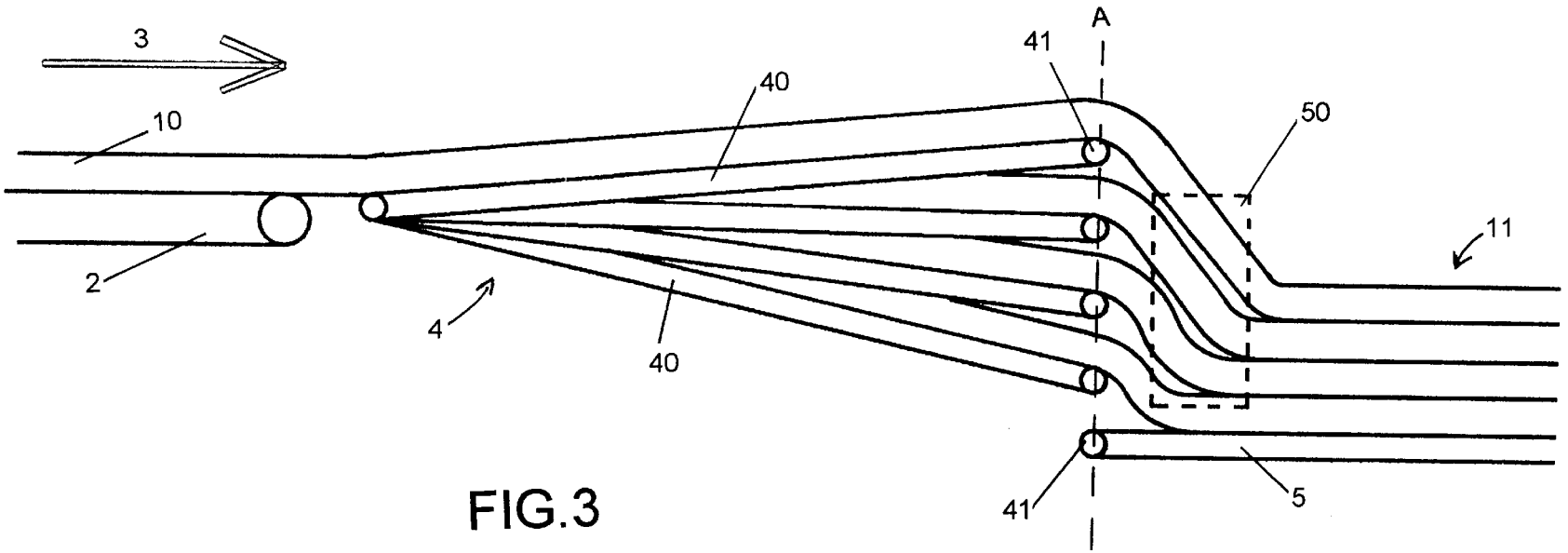
FIG. 3 is a side view of FIG. 2 according to an alternative embodiment.

In the embodiment described, the converging conveyor belts 40 rise and fall in relation to the plane of the transporting device 2; alternatively, the conveyor belts 40 could just as well be either rising or falling, as illustrated in FIG. 3 with the reception conveyor 5 positioned at the lowest point of the assembly as a whole.

Figure 4:
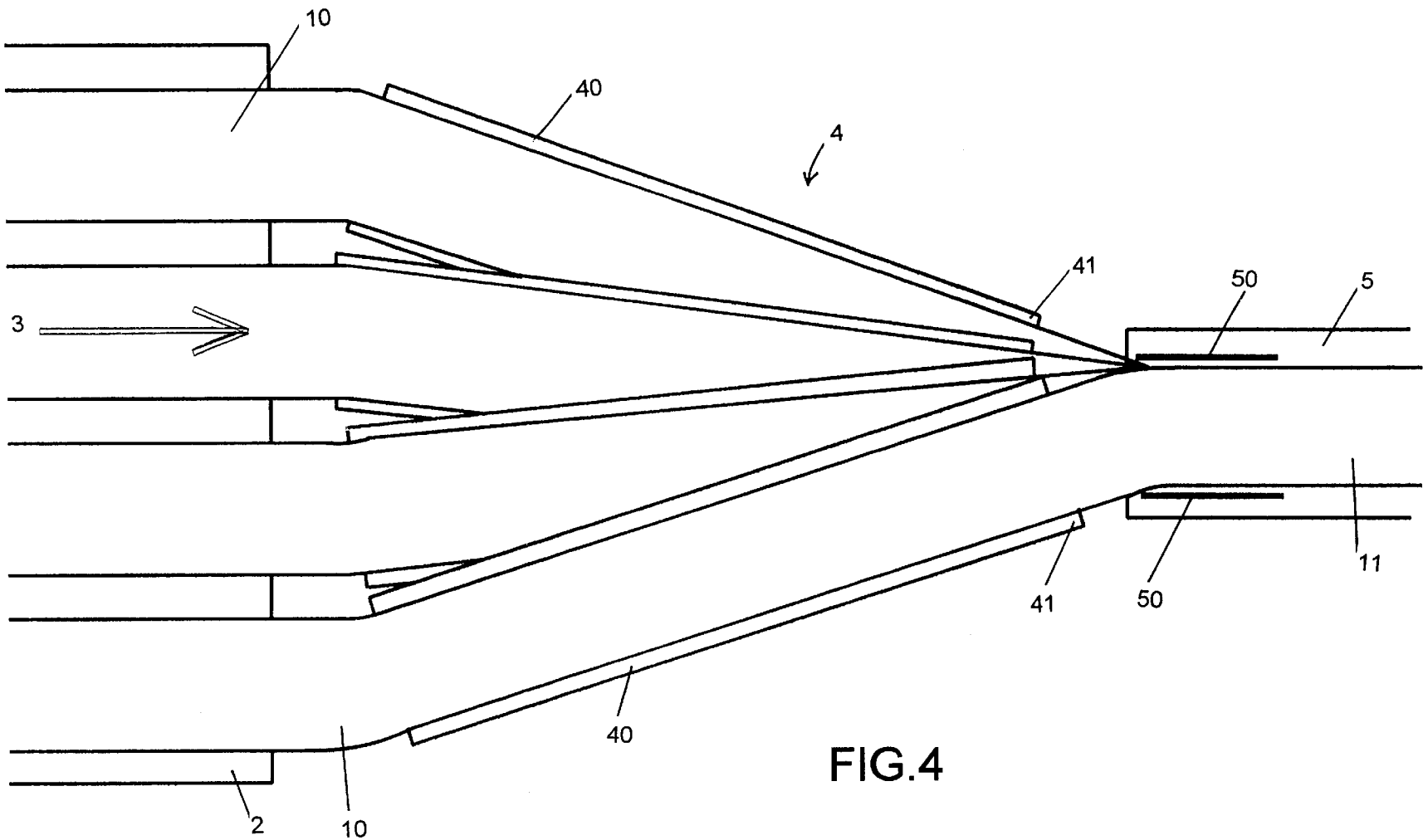
FIG. 4 is a top view of FIG. 2.

Preferably, flanges 50, which can be seen in FIGS. 2 to 4, are provided on the sides of and at the upstream end of the reception conveyor 5, in order to guide the mineral strips linearly on the reception conveyor 5 when the mineral strips are received.

In FIG. 1, illustrating mineral strips obtained from two half-width blankets, therefore, two branching-off and convergence devices 4 and two reception conveyors 5 are installed respectively. Of course, since the ultimate object is to stack all the mineral strips 10 obtained from the blanket at the outlet of the forming device, the reception conveyors 5, which transport the superposed strips of the respective half-width blankets, are positioned in order and in turn to converge towards a third reception conveyor 5*a* on which all the superposed strips are superposed.

Figure 5:
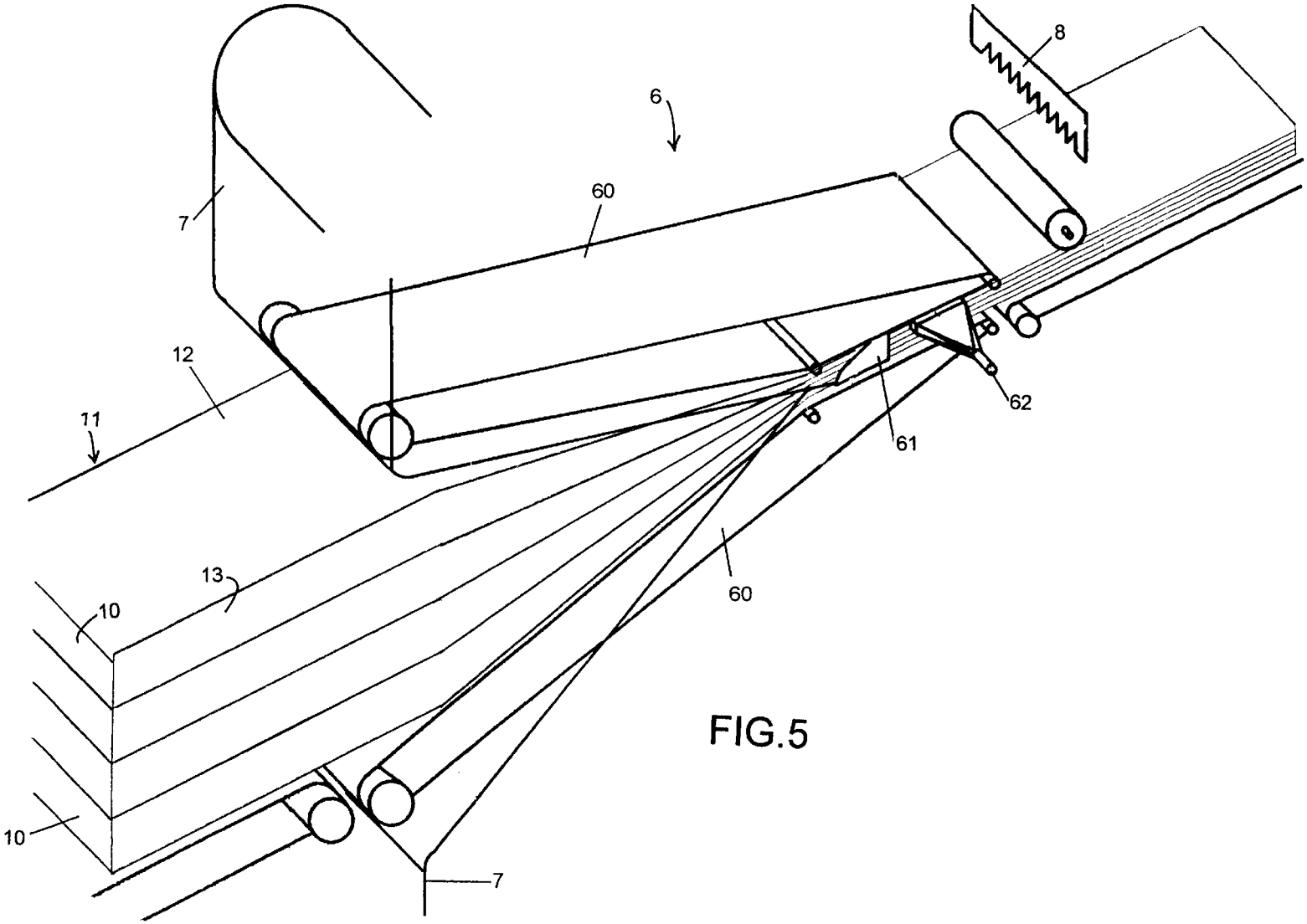
FIG. 5 shows a profile view of the downstream part of the device for carrying out the method.

Finally, a compression and packaging device 6, which can be seen in FIG. 5, is installed downstream of the reception conveyor 5, in order to compress the stack 11 of the four mineral strips and surround the stack with a packaging film 7, for subsequently maintaining the compression of and conditioning of the felts.

The compression and packaging device 6 includes two inclined conveying tracks 60 converging downstream of the compression and packaging device.

Located at the inlet of each track 60 is a packaging-film supply system, not illustrated, which delivers two films 7. The two films 7 have a width suitable for covering the longitudinal surfaces 12 of the compressed stack 11 and for covering the said films on the lateral faces 13 of the stack.

The films 7 are guided by rollers, not illustrated, so as to come into contact respectively with each of mutually confronting pressing surfaces of the tracks 60, the said pressing surfaces lay against the longitudinal faces 12 of the stack 11.

The films are driven preferably by means of the movement of the tracks 60, thus ensuring that the films are tensioned longitudinally against the longitudinal faces 12 of the stack 11.

At the end of the compression zone, the pressing surfaces of the tracks 60 are parallel and spaced by an amount which corresponds to the desired final compression height of the stack 11.

Arranged at the end of the compression zone are shapers 61, the function of which is to place the films 7 against lateral faces 13 of the stack. Additionally, mutual fastening device 62, such as for example particular hot-air nozzles, carry out autogenous welding of suitable plastic films. Else the application of, for example, an external glue of the hot-melt type or of a double-face adhesive serves to fasten the films.

Arranged at the outlet of the compression and packaging device 6 is a cutting device 8, such as for example a guillotine, the function of the cutting device is to cross-cut the stack 11 of mineral strips in order to produce felts of a desired length.

Finally, a final conditioning of the felts, which is not seen or detailed here, is carried out by a conventional machine which stacks a specific number of felts and envelops the stacks.

A method according to the present invention will now be described.

The half-width blanket of mineral fibers is delivered on the transporting device 2; whilst advancing in the direction 3, the half-width is cut longitudinally by circular saws in order to be converted into a plurality of mineral strips 10 parallel to one another.

At the downstream end of the transporting device 2, the conveyor belts 40 of the branching-off and convergence device 4 deflect each of the fibre strips 10 upwards and downwards angularly, in such a way that these arrive level at the ends 41 of the conveyor belts in vertical alignment.

The mineral strips 10 subsequently leave the ends 41 and are deposited by gravity onto the reception conveyor 5 in order to form the longitudinal stack 11.

The stack 11 subsequently enters the compression device 6, the longitudinal faces 12 of the stack coming into contact with the films 7 tensioned against the pressing surfaces of the tracks 60.

During its advance towards the convergence point of the tracks 60, the stack 11 is compressed, thus causing the packaging films 7 to project laterally against the lateral faces 13 of the stack. At the end of compression, when the stack is at the desired heights shapers 61 correctly turn down the films which are then fastened by the mutual fastening device 62.

At the outlet of the compression and packaging device 6, the compressed and packaged stack 11 is cross-cut by a cutting device 8. The cutting device such as a guillotine being operationed periodically as a function of the linear speed of movement of the stack, in order to obtain the appropriate felt length.

The invention thus makes it possible, by way of the branching-off and convergence device 4 and a guiding device, such the tranges 50, to deposit the strips on the stack 11, to gather together in a single processing line a plurality of strips and to compress, condition and cut in one operation, whereas the prior art needs one processing line per mineral strip extracted from the original fiber blanket.

Numerous modifications and variations of the present invention are possible in light of the above teachings. It is therefore to be understood that within the scope of the appended claims, the invention may be practiced otherwise than as specifically described herein.

What is claimed as new and described to be secured by Letters Patent of the United States is:

1. A method for the formation and conditioning of insulating felts of fibrous products, comprising the steps of:

transporting an insulating blanket continuously on a transporting device;

longitudinal sawing of the insulating blanket into a plurality of fiber strips; driving the fiber strips via at least one branching-off and convergence device towards at least one reception conveyor;

superposing on the at least one reception conveyor the fiber strips one on top of another so as to form at least one longitudinal stack of mineral strips;

compressing the at least one longitudinal stack by a compression device; and cross-cutting in a compressed state the at least one longitudinal stack in order to form the insulating felts.

2. The method according to claim 1, wherein the step of driving the fiber strips comprises the steps of:

deflecting the fiber strips from a traveling plane in at least one of a rising and a falling angular direction; and converging the fiber strips towards an axis which is perpendicular to the original traveling plane and level, such that the fiber strips arrive on the at least one reception conveyor in a coplanar form.

3. The method according to claim 2, wherein the step of superposing the fiber strips comprises the step of:

depositing, in alignment, the fiber strips by gravity onto the at least one reception conveyor to obtain a longitudinal stack.

4. The method according to any one of claims 1 to 3, further comprising the step of:

packaging, before cross-cutting, the at least one longitudinal stack with at least one packaging film around a longitudinal and lateral face of the stack.

5. The method according to claim 4, wherein the step of compressing comprises the step of:

covering, during the step of compressing, the at least one longitudinal stack with the at least one packaging film on the longitudinal and lateral face of each stack.

6. The method according to claim 5, wherein the step of covering comprises the step of:

applying a first and a second packaging film of the at least one packaging film against the longitudinal face of each stack, the first packaging film turned down against the lateral face after the step of compressing, and the second packaging film connected to the first packaging film by a mutual fastening device.

7. The method according to claim 1, wherein the step of driving the fiber strips comprises the steps of:

branching off the fiber strips according to a first and a second branching-off and convergence device which delivers a first and a second stack of the at least one longitudinal stack onto a first and a second reception conveyor of the at least one reception conveyor; and converging the fiber strips at a downstream end of the first and second reception conveyors onto a third reception conveyor to ensure that the first and second stacks are superposed as a third stack to be processed by the compression device.

8. The method according to claim 1, further comprising the step of:

covering, before the step of longitudinal sawing, the insulating blanket on an upper and lower face of the blanket with a functional covering.

9. The method according to claim 8, further comprising the step of:

splitting, simultaneously with or just downstream of the step of covering, the insulating blanket into according to a thickness of the insulating blanket.

10. The method according to claim 1, wherein the step of transporting comprises the step of:

transporting as the insulating blanket a mineral fiber.

11. A device for forming and conditioning insulating felts, comprising:

a transporting device configured to transport an insulating blanket;

a longitudinal cutting device configured to longitudinally cut the insulating blanket into a plurality of fiber strips;

at least one branching-off and convergence device configured to drive the fiber strips from the transporting device;

at least one reception conveyor configured to receive the fiber strips from the at least one branching-off and convergence device and configured to form at least one longitudinal stack;

a compression device configured to compress the at least one longitudinal stack; and a cross-cutting device configured to cross cut in a compressed state the at least one longitudinal stack in order to form the insulating felts, wherein the at least one branching-off and convergence device includes individual conveyor belts with each individual conveyor belt having a departure point at a junction of the transporting device and in alignment with the fiber strips and an arrival point aligned along a vertical axis and above the at least one reception conveyor.

12. The device according to claim 11, further comprising:

guide flanges provided on each side of and at an upstream end of the at least one reception conveyor to ensure alignment of the at least one longitudinal stack.

13. Device according to claim 11, wherein the compression device comprises two converging tracks having pressing surfaces configured, during compression, to deposit packaging films on longitudinal faces of the at least one longitudinal stack.

14. Device according to claim 11, wherein cross-cutting device is arranged downstream of the compression device and configured to cross-cut a compressed and packaged stack.

* * * * *